US008469834B2

(12) United States Patent
Wada et al.

(10) Patent No.: US 8,469,834 B2
(45) Date of Patent: Jun. 25, 2013

(54) GOLF CLUB HEAD

(75) Inventors: Kozue Wada, Chichibu (JP); Hideo Matsunaga, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 642 days.

(21) Appl. No.: 12/649,798

(22) Filed: Dec. 30, 2009

(65) Prior Publication Data

US 2010/0304889 A1 Dec. 2, 2010

(30) Foreign Application Priority Data

Jun. 2, 2009 (JP) ..... 2009-133323

(51) Int. Cl.
*A63B 53/04* (2006.01)

(52) U.S. Cl.
USPC ..... 473/346; 473/342

(58) Field of Classification Search
USPC ..... 473/324, 345–346
See application file for complete search history.

(56) References Cited

U.S. PATENT DOCUMENTS

| | | | | |
|---|---|---|---|---|
| 2,087,685 | A | 7/1937 | Hackney | |
| 3,814,437 | A | 6/1974 | Winquist | |
| 5,377,985 | A | 1/1995 | Ohnishi | |
| 5,547,427 | A | 8/1996 | Rigal et al. | |
| 5,669,829 | A | 9/1997 | Lin | |
| 5,718,641 | A * | 2/1998 | Lin | 473/224 |
| 5,830,084 | A | 11/1998 | Kosmatka | |
| 6,840,872 | B2 | 1/2005 | Yoneyama | |
| 6,899,638 | B2 | 5/2005 | Iwata et al. | |
| 6,926,618 | B2 | 8/2005 | Sanchez et al. | |
| 7,220,190 | B2 | 5/2007 | Hirano | |
| 7,258,626 | B2 | 8/2007 | Gibbs et al. | |
| 7,387,579 | B2 | 6/2008 | Lin et al. | |
| 7,442,132 | B2 * | 10/2008 | Nishio | 473/342 |
| 7,494,426 | B2 | 2/2009 | Nishio et al. | |
| 7,578,755 | B2 | 8/2009 | Oyama | |
| 7,614,964 | B2 | 11/2009 | Matsunaga | |
| 7,618,331 | B2 | 11/2009 | Hirano | |
| 7,993,214 | B2 | 8/2011 | Hirano | |
| 8,012,041 | B2 | 9/2011 | Gibbs et al. | |
| 8,070,623 | B2 | 12/2011 | Stites et al. | |

(Continued)

FOREIGN PATENT DOCUMENTS

| | | |
|---|---|---|
| JP | 9-154985 A | 6/1997 |
| JP | 9-239075 A | 9/1997 |

(Continued)

OTHER PUBLICATIONS

Japanese Office Action issued in Japanese Application No. 2009-133323 dated Jan. 7, 2013.

*Primary Examiner* — Stephen L. Blau
(74) *Attorney, Agent, or Firm* — Sughrue Mion, PLLC

(57) ABSTRACT

A golf club head having a hollow construction includes a face part having a ball-impacting surface and a first main rib and a second main rib disposed on the inner surface of the face part. The first main rib extends from a crown side to a sole side, and the second main rib extends from a hosel side to a toe-side part of the sole side, the first and second main ribs intersecting each other. The material thickness on a toe side of the face part, with the first main rib being the boundary, is formed so as to be thinner than the material thickness on a heel side of the face part.

6 Claims, 4 Drawing Sheets

U.S. PATENT DOCUMENTS

| | | | | |
|---|---|---|---|---|
| 8,226,498 | B2 | 7/2012 | Stites et al. | |
| 2003/0220157 | A1* | 11/2003 | Dennis et al. | 473/342 |
| 2004/0132544 | A1* | 7/2004 | Doi | 473/345 |
| 2006/0111201 | A1* | 5/2006 | Nishio et al. | 473/346 |
| 2010/0105501 | A1 | 4/2010 | Wada et al. | |

FOREIGN PATENT DOCUMENTS

| | | | |
|---|---|---|---|
| JP | 2878980 | B2 | 1/1999 |
| JP | 11-216204 | A | 8/1999 |
| JP | 2002-35178 | A | 2/2002 |
| JP | 3315618 | B2 | 6/2002 |
| JP | 2003-180887 | A | 7/2003 |
| JP | 2003-290398 | A | 10/2003 |
| JP | 2006-141806 | A | 6/2006 |
| JP | 2006-230772 | A | 9/2006 |
| JP | 2007-89831 | A | 4/2007 |
| JP | 2008-36050 | A | 2/2008 |
| JP | 2008-132276 | A | 6/2008 |

* cited by examiner

GOLF CLUB HEAD

BACKGROUND OF THE INVENTION

The present invention relates to a golf club head, and more specifically, relates to a golf club head with improved material thickness on the inner surface of the face part.

The majority of the heads of recent wood clubs have at least the face part thereof formed of a metal material. The material thickness of the face part must be thick enough to maintain sufficient strength to withstand the impact with the ball. While heads are becoming larger, because of the rule that they must have a volume less than 460 $cm^3$ plus a tolerance of 10 $cm^3$, large heads that come very close to the upper limit of 460 $cm^3$ account for the majority of driver heads.

When heads increase in size in this manner, because the face part becomes heavy, in order to both reduce the weight of the face part and maintain the strength of the face part, the material thickness of the face part is reduced and ribs are provided on the inner surface of the face part. For example, Japanese Patent Application Publication 2006-141806 discloses the provision of six ribs that extend from a center part of the face toward the periphery of the face.

Japanese Patent Application Publication 2008-36050 states that, when ribs are provided so as to form an X-shape at the center part of the inner surface of the face part, the repulsion performance of the face part when a ball is hit at a point away from the face center, at the sole side or crown side, is greatly reduced from the case of hitting the ball at the face center and, in order to solve this problem, describes making the material thicknesses in four divided surfaces on the inner surface of the face delineated by the ribs such that the thickness is less at the sole side and crown side than it is at the toe side and heel side.

SUMMARY OF THE INVENTION

In the past, many high-repulsion heads with significantly increased coefficients of restitution have been developed. High-repulsion heads having a coefficient of restitution of 0.830 or greater, however, have not been usable in competition since 2008. At present, therefore, while golf club heads with a suppressed coefficient of restitution at the center of the face part have been developed, when the coefficient of restitution at the center of the face part is suppressed, the repulsion performance at parts of the face surface other than the center, and particularly at the toe side in comparison to the heel side, is low.

Accordingly, in consideration of the above-noted problem, the present invention has as an object to provide a golf club head that, while maintaining the lightening of the face part and maintaining the strength of the face part, not only enables the suppression of repulsion at the face center to within a range that complies with the rules, but also, even in the case in which the ball is hit at a point away from the face center, can exhibit uniform repulsion performance, whether at the toe side or at the heel side.

To achieve the above-noted object, a golf club head according to the present invention is a head having a structure that is internally hollow, and includes a face part having a ball-impacting surface; and a first main rib and a second main rib disposed on the inner surface of the face part, the first main rib extending from a crown side to a sole side, and the second main rib extending from a hosel side to a toe-side part of the sole side, the first and second main ribs intersecting each other, wherein the material thickness on a toe side of the face part, with the first main rib being the boundary, is formed so as to be thinner than the material thickness on a heel side of the face part.

The face part, with the first and second main ribs as boundaries, is divided into four regions, a region on both the toe-side and the crown-side, a region on both the toe-side and the sole-side, a region on both the heel-side and the crown-side, and a region on both the heel-side and the sole-side. The material thickness of the toe-side and also the crown-side region of the face part is preferably made thinner than the material thickness of the heel-side and also sole-side region of the face part, and the material thickness of the heel-side and also crown-side region of the face part is preferably made thicker than the material thickness of the toe-side and also sole-side region of the face part.

The golf club head according to the present invention preferably has a center of gravity that, when projected onto the face plane, is included in the intersection part of the first and second main ribs. Also, the golf club head according to the present invention preferably further has a reinforcing rib that extends from the part at which the first and second main ribs intersect toward the end part of the face part, and it is preferable that the reinforcing rib have a thickness that gradually decreases moving away from the intersection part toward the end part, and is formed to midway to the end part of the face part.

According to the present invention, by causing a first main rib extending from the crown side toward the sole side and the second main rib extending from the hosel side to the toe side of the sole to intersect and forming the material thickness of the face part on the toe-side, with the first main rib as the boundary, thinner than the material thickness on the heel side while maintaining the lightness and the strength of the face part, in addition to being able to suppress the repulsion of the face center to within a range that complies with the rules, it is possible to exhibit uniform repulsion performance, whether at the toe side or at the heel side.

DESCRIPTION OF THE PREFERRED EMBODIMENTS

Aspects of an embodiment of a golf club head according to the present invention are described below, with reference made to the accompanying drawings.

Figure 1:
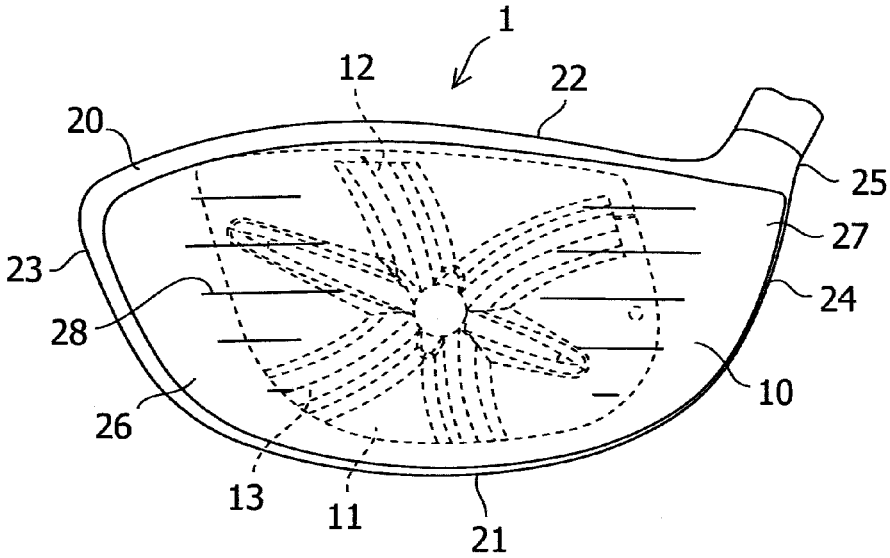
FIG. 1 is a front elevational view showing an embodiment of a golf club head according to the present invention.

As shown in FIG. 1, a golf club head 1 is mainly constituted by a face member 11 that forms a portion of a face part 10 and a main body member 20. The main body member 20 is integrally formed and has a portion of the face part 10, a sole part 21, a crown part 22, and a side part and hosel part 25 that extend from a toe 23, to pass though to a back face (not illustrated) to reach the heel 24. The face member 11 and the main body member 20 are joined by welding, thereby achieving a head with an internally hollow structure.

The face member 11 preferably includes at least a sweet area of the face part 10. The width of the face member 11 is preferably approximately 55% of the width of the face part 10 or greater, and more preferably approximately 60% or greater. The width of the face member 11 is preferably approximately 90% of the width of the face part 10 or less, and more preferably approximately 85% or less. The height of the face member 11 is preferably approximately 50% of the height of the face part 10 or greater, and more preferably approximately 55% or greater. The height of the face member 11 is preferably approximately 90% of the height of the face part 10 or less and more preferably approximately 85% or less. The outer periphery of the toe side and the heel side of the face member 11 is preferably substantially parallel with the center axis 31 of the first main rib 12, described later. The main body member 20 preferably has a face part toe-side part 26 and a face part heel-side part 27.

In FIG. 1, elements on the surface on the internal hollow part of the face member 11, this being the inner surface, are shown by broken lines. Ribs at which there is a partial thickening of the material thickness of the face member 11 are formed on the inner surface of the face member 11. The inner surface of the face member 11 is described below.

Figure 2:
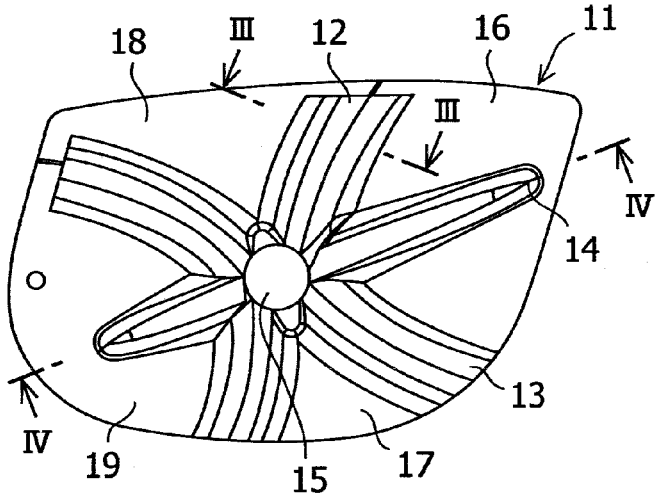
FIG. 2 is a rear elevational view showing the face member of the golf club head shown in FIG. 1.

As shown in FIG. 2, a first main rib 12 extending from the sole side to the crown side and a second main rib 13 extending from the hosel side to the toe side are formed on a substantially flat surface on the rear side of the face member 11. The first and second main ribs 12, 13 intersect at an intersection part 15 that is circularly shaped when viewed in a direction perpendicular thereto and that is located in the sweet area of the face part 10. By the first and second main ribs 12, 13 intersecting in this manner at the center part of the face part 10, it is possible to suppress the repulsion performance at the center part of the face part 10.

The inner surface of the face member 11 is divided by the first and second main ribs 12, 13 into four regions: a toe-crown region 16, a toe-sole region 17, a heel-crown region 18, and a heel-sole region 19. The material thickness of the face member 11 is formed so as to differ, with the first main rib 12 as a boundary. That is, the material thickness of the toe-crown region 16 and the toe-sole region 17 is thinner than the material thickness of the heel-crown region 18 and the heel-sole region 19. By making the toe side of the face member 11 thinner than the heel side thereof in this manner, it is possible to increase the toe-side repulsion performance and achieve uniformity of repulsion performance between the toe side and the heel side.

A reinforcing rib 14 extending from the toe-crown region 16 to the heel-sole region 19 is formed on the inner surface of the face member 11. The reinforcing rib 14 intersects with the first and second main ribs 12, 13 at the intersection part 15. By forming the reinforcing rib 14 in a case in which the repulsion performance of the toe-crown region 16 and the heel-sole region 19 exceeds the range of compliance with the rules, the repulsion performance of these regions can be suppressed. A further detailed description of the parts on the inner surface of the face member 11 is presented below.

Figure 3:
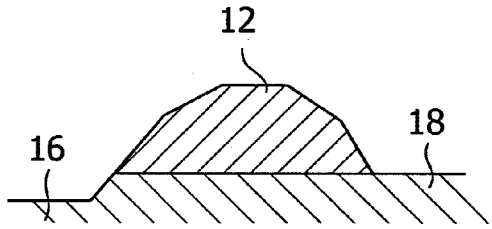
FIG. 3 is a schematic cross-sectional view showing the face member of FIG. 2 along the line III-III.

As shown in FIG. 3, the first main rib 12 is formed so that the material thickness at the center thereof is the greatest, and so that the material thickness decreases toward the flat toe-crown region 16 and the heel-crown region 18. That is, the first main rib 12 has a cross-sectional shape that is substantially semicircular or substantially semi-elliptical. This cross-sectional view is for the purpose of aiding in understanding the constitution of the present invention and is not drawn to scale. Also, the first main rib 12 is formed so that the material thickness thereof is constant moving away from the intersection part 15 toward the outer periphery of the face member 11. The material thickness of the second main rib 13 is constituted in the same manner as that of the first main rib 12.

The difference between the material thickness at the thickest part thereof of the first and second main ribs 12, 13 and the material thickness at the thickest region of the neighboring regions is preferably at least approximately 0.3 mm and more preferably at least approximately 0.5 mm or greater. The material thickness difference is preferably made approximately 4.0 mm or less, and more preferably made approximately 3.5 mm or less. The first and second main ribs 12, 13 are preferably formed up to edge part of the face member 11 or up to the vicinity thereof. Also, the first and second main ribs 12, 13 are each formed so as to have a substantially uniform width. The width of the first and second main ribs 12, 13 at the part in contact with the face inner surface is preferably approximately 2 mm or greater and more preferably approximately 3 mm or greater. The width of the first and second main ribs 12, 13 is preferably approximately 12 mm or less and more preferably approximately 10 mm or less.

Figure 4:
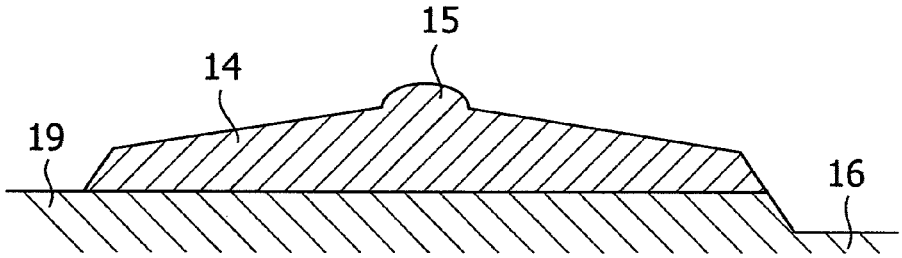
FIG. 4 is a schematic cross-sectional view showing the face member of FIG. 2 along the line IV-IV.

The reinforcing rib 14, in the same manner as the main ribs, is formed so as to have a material thickness that is the greatest at the center and that decreases moving toward the flat toe-crown region 16 or the heel-sole region 19. The material thickness of the reinforcing rib 14, as shown in FIG. 4, is formed so as to gradually decrease moving away from the intersection part 15 toward the outer periphery of the face member 11. This cross-sectional view is also not drawn to scale. The width of the reinforcing rib 14 is also formed so that it gradually narrows moving away from the intersection part 15 toward the outer periphery of the face member 11. By both thinning and narrowing the reinforcing rib 14 moving away from the center side toward the outer periphery in this manner, it is possible to suppress a sudden change in rigidity.

The length of the reinforcing rib 14 from the intersection part 15 is preferably approximately 45% or greater of the length to the outer periphery of the face member 11, and more preferably approximately 50% or greater. This is preferably approximately 90% or less, and more preferably approximately 85% or less. The lengths on the toe side and on the heel side may be either the same or different. Although the material thickness of the reinforcing rib 14 is preferably such that the thickest part is as thick as the thickest part of the first and second main ribs 12, 13, and the thickness may be made thinner than the first and second main ribs 12, 13. In the case of making the material thickness thinner, it is preferable that the difference be approximately 0.1 mm or greater and approximately 0.5 mm or less. The width of the reinforcing rib 14 at the thickest part is preferably approximately 2 mm or greater and more preferably approximately 3 mm or greater. The width of the reinforcing rib 14 is preferably approximately 12 mm or less, and more preferably approximately 10 mm or less.

Figure 5:
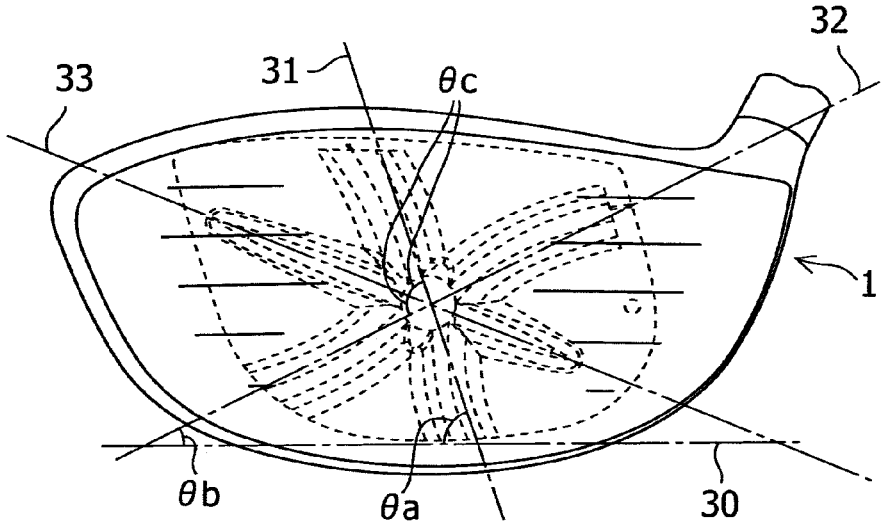
FIG. 5 is a front elevational view showing the angles of the ribs in the face member of FIG. 1.
Figure 6:
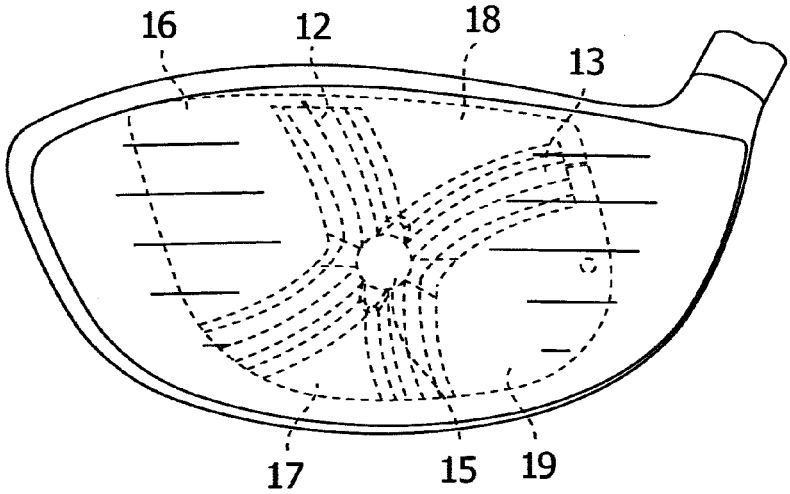
FIG. 6 is a front elevational view showing another embodiment of a golf club head according to the present invention.

The first main rib 12 preferably is inclined toward the toe side at the crown side and toward the heel side as the sole side. By inclining the first main rib 12 in this manner, it is possible to achieve the maximum repulsion performance in the direction from the upper side of the toe toward the lower side of the heel, in which area the impact points for amateur golfers concentrate. Specifically, as shown in FIG. 5, when the golf club head is placed in the usual address position, the inclination angle θa of the center axis 31 of the first main rib 12 with respect to the horizontal line 30 is preferably approximately 90° or less, and more preferably approximately 85° or less. It is also preferable that the rib inclination θa be approximately 25% or greater and more preferably approximately 30° or greater.

The second main rib 13 preferably is inclined toward the sole side at the toe side and toward the crown side at the heel side, that is, inclined toward the hosel side. By inclining the second main rib 13 in this manner, it is possible to achieve the maximum repulsion performance at above the toe. Specifically, it is preferable that the inclination θb of the center axis 32 of the second main rib 13 with respect to the horizontal line 30 be approximately 5° or greater, and more preferably approximately 10° or greater. It is also preferable that the angle θb be approximately 80° or less, and more preferably approximately 70° or less. It is preferable that the center axis 33 of the reinforcing rib 14 divide into two equal parts the angle formed between the center axes 31 and 32 of the first and second main ribs 12, 13.

Rather than having the first main rib 12 be a straight line along the center axis 31, by having it describe a smooth curve such as an S-shape or a Z-shape and rather than having the second main rib 13 be a straight line along the center axis 32, by having it describe a smooth curve such as an S-shape or a Z-shape, it is possible to make the surface areas of both the toe-crown region 16 and the heel-sole region 19 large. The reinforcing rib 14 is preferably made a straight line along the center axis 33.

The toe-crown region 16, the toe-sole region 17, the heel-crown region 18, and the heel-sole region 19 each have substantially uniform material thicknesses. In order to make the repulsion performance uniform between the toe side and the heel side, the material thickness of the toe-crown region 16 is made thinner than the material thickness of the heel-sole region 19, and also the material thickness of the toe-sole region 17 is made thinner than the material thickness of the heel-crown region 18. The difference between these thicknesses needs to be at least approximately 0.025 mm, is preferably approximately 0.05 mm or greater, and more preferably approximately 0.1 mm or greater. This is because if the difference in material thickness is too large, it is not possible to achieve uniform repulsion performance, the difference in material thickness is preferably approximately 0.5 mm or less and more preferably approximately 0.4 mm or less.

Although the material thickness of the toe-crown region 16 and the material thickness of the toe-sole region 17 may be either the same or different, to achieve more uniformity in the coefficient of restitution between the toe side and the heel side, it is preferable that the material thickness of the toe-sole region 17 be thinner than that material thickness of the toe-crown region 16. The difference between these thicknesses is preferable approximately 0.05 mm or greater, and more preferably approximately 0.1 mm or greater. Because if the difference between these thicknesses is too large, it is not possible to achieve uniform repulsion performance, the difference in material thickness is preferably approximately 0.5 mm or less and more preferably approximately 0.4 mm or less.

The material thickness of the heel-crown region 18 and the material thickness of the heel-sole region 19 may be either the same or different. If the material thicknesses between the heel-crown region 18 and the heel-sole region 19 are made different, it is preferable that the material thickness difference be approximately 0.05 mm or greater, and more preferably approximately 0.5 mm or greater.

The intersection part 15 includes the sweet spot of the face part 10, that is, the center of gravity of the golf club head when projected onto the face plane. The intersection part 15 includes the point of intersection between the first and second main ribs 12, 13. The point of intersection of the main ribs and the sweet spot may be the same or may be different. The point of intersection between the main ribs 12, 13 is disposed on a score line formed in the surface of the face part 10 or, as shown in FIG. 1, is disposed on an extension of a score line 28 formed partially on the toe side and the heel side.

The material thickness of the intersection part 15 is preferably made the same as the material thickness of the thickest part of the first and second main ribs 12, 13, but may also be made thicker. In the case of making the intersection part 15 thicker than the main ribs, the difference in material thicknesses is preferably approximately 0.1 mm or greater and approximately 0.5 mm or less. The surface of the intersection part 15 is preferably a curved surface and, as shown in FIG. 4, has a substantially semicircular or semi-elliptical shape. The radius at the widest part of the circular shape of the intersection part 15 when viewed in a direction perpendicular thereto is preferably approximately 5 mm or greater and approximately 12 mm or less. The intersection part 15 is not restricted to a circular shape, and may be elliptical, a quadrangular shape such as an elongated rectangular or diamond shape, or a polygonal shape such as a square, a pentagon, or a hexagon.

Although the material thicknesses of the toe-crown region 16, the toe-sole region 17, the heel-crown region 18, and the heel-sole region 19 have the above-described differences with respect to the material thickness in other regions, the differences in thickness are generally preferably approximately 0.1 mm or greater and more preferably approximately 1.5 mm or greater. The material thickness in each region is preferably approximately 3.0 mm or less and more preferably approximately 2.5 mm or less. Although the material thicknesses of the thickest part of the first and second main ribs 12, 13 and the reinforcing rib 14 (that is, the distance from the face surface) have the above-described differences with respect to the material thicknesses in each region, they are preferably approximately 3.0 mm or greater and more preferably approximately 3.2 mm or greater. The material thickness of these ribs is preferably approximately 4.2 mm or less and more preferably approximately 4.0 mm or less.

The face member 11 can be formed by either forging or casting. The material of the face member 11 may be titanium or a titanium alloy, or stainless steel or the like. The volume of the golf club head 1 is preferably approximately 100 $cm^3$ or greater and more preferably approximately 150 $cm^3$ or greater. It is also preferable that the volume of the golf club head 1 be approximately 500 $cm^3$ or less and more preferably approximately 460 $cm^3$ or less. The weight of the golf club head 1 is preferably approximately 170 g or greater and more preferably approximately 175 g or greater. The weight of the golf club head 1 is also preferably approximately 250 g or less, and more preferably approximately 245 g or less.

Although in the above-described embodiment, as shown in FIG. 1 through FIG. 5, a reinforcing rib 14 is provided, the present invention does not require the provision of a reinforcing rib. In the case in which there is no reinforcing rib 14, the joining part between the neighboring first and second main ribs 12, 13 is preferably made a smoothly curved shape.

Example

Face members were fabricated according to the present invention and the coefficients of restitution (COR) thereof were evaluated. In this embodiment, rather than actually measuring the COR value, the characteristic time (CT) was measured. The CT value is a value that enables simple and accurate measurement of the spring effect of the face and that has been adopted by the United States Golf Association in the US and the R&A in the United Kingdom, and which can be measured using a portable pendulum machine that is approved by the R&A Rules Limited. In general, because the more the face flexes, the less is the loss of energy and the higher is the initial speed of the ball, the CT value is an indication of the flexing, expressed as the amount of time of contact between the ball and the face. At present, the rules have an upper limit of 257 (standard value of 239 plus a tolerance of 18) μs.

Table 1 shows the material thicknesses at the intersection part, the toe-crown region, the toe-sole region, the heel-crown region, and the heel-sole region of face members according to the present invention in which the toe-side material thickness was made thinner than the heel side (Examples 1 and 2). In Example 1 and Example 2, a reinforcing rib was provided. A face member having the same material thicknesses, but without the reinforcing rib, was taken as Example 3. For the purpose of comparison, Comparative Example 1, provided with a reinforcing rib and having the same material thickness in all regions, and Comparative Example 2, without a reinforcing rib and having the same material thickness in all regions, were also fabricated. In Examples 1 to 3 and Comparative Examples 1 and 2, the material thickness of the first and second main ribs and the reinforcing rib 14 were the same as at the intersection part.

TABLE 1

| | Local material thicknesses (mm) | | | | | |
|---|---|---|---|---|---|---|
| | Intersection part | Toe-crown | Toe-sole | Heel-crown | Heel-sole | Reinforcing rib |
| Example 1 | 3.6 | 2.25 | 2.1 | 2.3 | 2.3 | Present |
| Example 2 | 3.6 | 2.2 | 2.0 | 2.3 | 2.4 | Present |
| Example 3 | 3.6 | 2.25 | 2.1 | 2.3 | 2.3 | Not present |
| Comparative Example 1 | 3.6 | 2.25 | 2.25 | 2.25 | 2.25 | Present |
| Comparative Example 2 | 3.6 | 2.3 | 2.3 | 2.3 | 2.3 | Not present |
| Comparative Example 3 | 3.5 | 2.4 | 2.3 | 2.3 | 2.1 | Present |

As common face member conditions, the width of the face member was made 75 mm and the height thereof was made 43 mm, the first and second main ribs were inclined as shown in FIG. 1, and the length of the reinforcing rib was made 27 mm on the toe side and 25 mm on the heel side. The width of the first and second main ribs was made 9.5 mm and the width of the reinforcing rib was made 7.1 mm. As common golf club head conditions, the material of the face member was a titanium alloy (Ti-6Al-4V), the head volume was made 460 $cm^3$, and the head weight was made 190 g.

Figure 7:
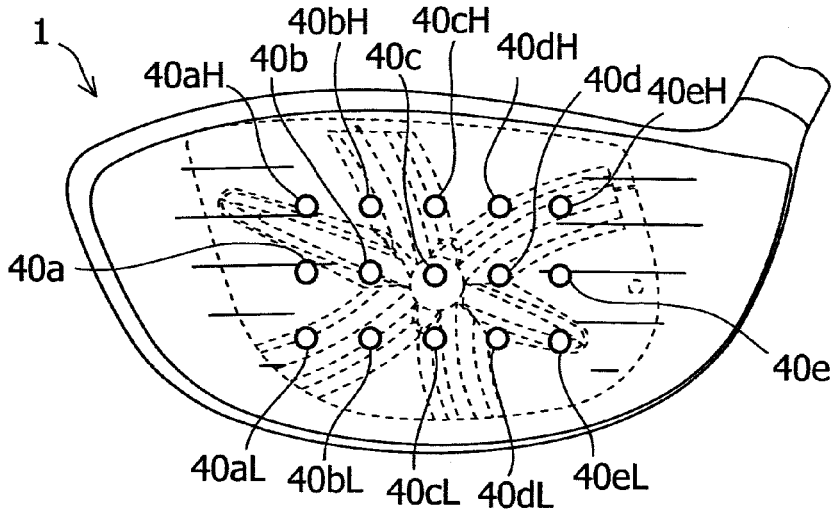
FIG. 7 is a front elevation view showing points of impact in a simulation of Examples.

The CT value at the ball impact point was measured for the examples and the comparative examples. As shown in FIG. 7, the test was performed with regard to 15 ball impact points differing in the vertical direction and the horizontal direction. The center impact point 40*c* assumed an impact with the ball at the sweet spot, and was taken to be within the intersection part of the face member 11. For the 14 other impact points, the assumption was that of a ball impact was removed from the sweet spot. Positions removed from the center impact point 40*c* by 10 mm toward the toe side and the heel side were taken as impact points 40*b* and 40*d*, and positions removed from the center impact point 40*c* by a further 10 mm toward the toe side and the heel side were taken as impact points 40*a* and 40*e*. Positions removed from the 5 impact points 40*a* to 40*e* by 10 mm on the crown side and the sole side were taken as impact points 40*a*H to 40*e*H and 40*a*L to 40*e*L.

Figure 8:
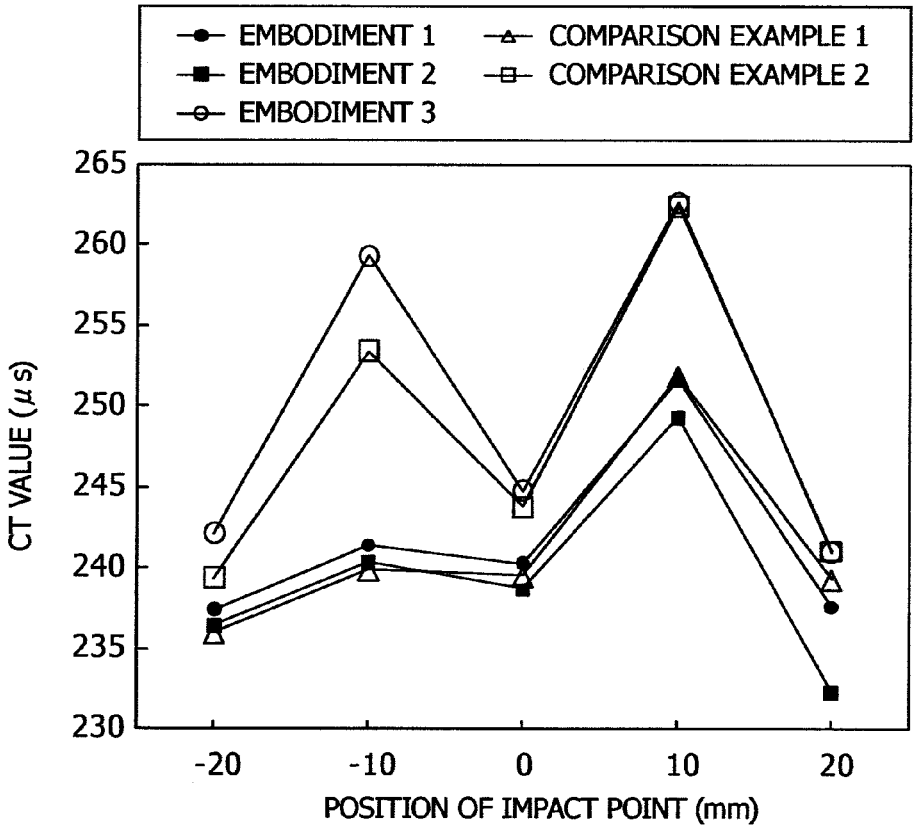
FIG. 8 is a graph showing the results for the CT values of Examples 1 to 3 and Comparative Examples 1 and 2.

The CT values at each of the impact points were measured for Examples 1 to 3 and Comparative Examples 1 and 2 under the above-noted conditions. The results obtained are shown in Table 2 to Table 6. From the results, the CT values for the impact points 40*a* to 40*e* were extracted and plotted as the graph of FIG. 8. In the graph of FIG. 8, the position of the center impact point 40*c* is taken as 0 mm, with distances toward the heel side taken as positive and distances toward the toe side taken as negative.

TABLE 2

| | CT Value (μs) | | | | |
|---|---|---|---|---|---|
| Example 1 | −20 mm | −10 mm | 0 mm | 10 mm | 20 mm |
| 10 mm | — | 237 | 237 | 242 | 239 |
| 0 mm | 237 | 241 | 240 | 252 | 238 |
| −10 mm | 192 | 226 | 229 | 235 | 198 |

TABLE 3

| | CT Value (μs) | | | | |
|---|---|---|---|---|---|
| Example 2 | −20 mm | −10 mm | 0 mm | 10 mm | 20 mm |
| 10 mm | — | 236 | 236 | 240 | 240 |
| 0 mm | 236 | 240 | 239 | 249 | 232 |
| −10 mm | 191 | 225 | 224 | 232 | 193 |

TABLE 4

| | CT Value (μs) | | | | |
|---|---|---|---|---|---|
| Example 3 | −20 mm | −10 mm | 0 mm | 10 mm | 20 mm |
| 10 mm | — | 246 | 239 | 243 | 240 |
| 0 mm | 242 | 259 | 245 | 263 | 241 |
| −10 mm | 193 | 228 | 232 | 241 | 202 |

TABLE 5

| Comparative | CT Value (μs) | | | | |
|---|---|---|---|---|---|
| Example 1 | −20 mm | −10 mm | 0 mm | 10 mm | 20 mm |
| 10 mm | — | 236 | 237 | 242 | 240 |
| 0 mm | 236 | 240 | 239 | 252 | 239 |
| −10 mm | 191 | 224 | 221 | 236 | 200 |

TABLE 6

| Comparative | CT Value (μs) | | | | |
|---|---|---|---|---|---|
| Example 2 | −20 mm | −10 mm | 0 mm | 10 mm | 20 mm |
| 10 mm | — | 238 | 238 | 243 | 240 |
| 0 mm | 239 | 253 | 244 | 262 | 241 |
| −10 mm | 191 | 225 | 223 | 241 | 202 |

As shown in FIG. 8, although the CT values for face members (Example 1 and Example 2), in which the material thickness was made thinner on the toe side than on the heel side, were slightly higher at an impact point that was +10 mm from the center, it was possible to obtain CT values that were substantially uniform. For the case in which the material thicknesses in all regions was made equal (Comparative Example 1), the CT values were higher on the heel side than on the toe side. For the case of a face member in which the material thickness was made thinner at the toe side than at the heel side and in which a reinforcing rib was not provided (Example 3), although the CT values were higher at the heel side and the toe side, it was possible to obtain substantially uniform CT values between the heel side and toe side. For a face member in which the material thicknesses in all regions were uniform and in which a reinforcing rib was not provided (Comparative Example 2), the CT values were higher at the toe side than at the heel side, and also the heel side and toe side CT values were high overall.

Additionally, for the purpose of comparison, a face member in which the material thickness at the toe side was greater than at the heel side was fabricated (Comparative Example 3). Each of the material thickness values is shown in Table 1. The CT values were measured in the same manner for Comparative Example 3, the results being as shown in Table 7. With regard to the results for Example 1 and Comparative Example 3, the CT values for impact points 40*a* to 40*e* were extracted and plotted as the graph of FIG. 9.

TABLE 7

| Comparative | CT Value (μs) | | | | |
|---|---|---|---|---|---|
| Example 3 | −20 mm | −10 mm | 0 mm | 10 mm | 20 mm |
| 10 mm | — | — | 238 | — | — |
| 0 mm | 231 | 240 | 245 | 257 | 258 |
| −10 mm | — | — | 232 | — | — |

Figure 9:
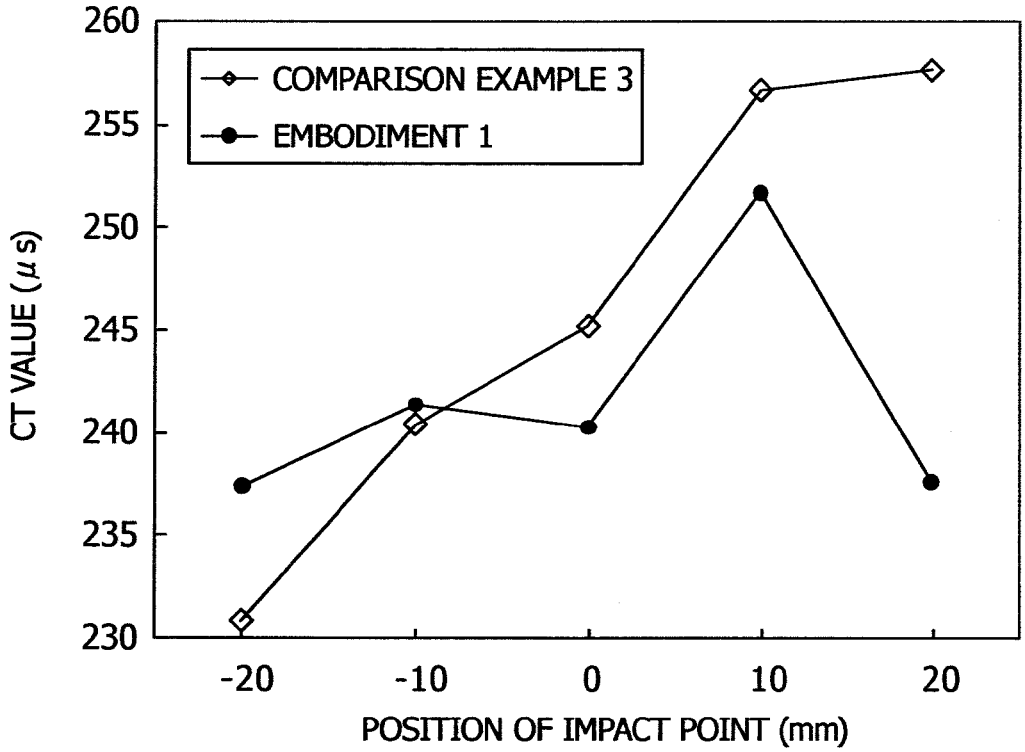
FIG. 9 is a graph showing the results for the CT values of Example 1 and Comparative Example 3.

As shown in FIG. 9, the CT values for a face member in which the toe side material thickness was made greater than that of the heel side (Comparative Example 3) decreased more the greater the distance toward the toe side, and increased more the greater the distance toward the heel side.

What is claimed is:

1. A golf club head having a hollow construction, comprising:

a face part having a ball-impacting surface; and a first main rib and a second main rib disposed on the inner surface of the face part, the first main rib extending from a crown side to a sole side, and the second main rib extending from a hosel side to a toe-side part of the sole side, the first and second main ribs intersecting each other, wherein the material thickness on a toe side of the face part which is not of any rib, with the first main rib being the boundary, is formed so as to be thinner than the material thickness on a heel side of the face part which is not part of any rib, and wherein there is not more than three ribs on the inner surface of the face part.

2. The golf club head according to claim 1, wherein the face part, with the first and second main ribs as boundaries, is divided into four regions, a region on both the toe-side and the crown-side, a region on both the toe-side and the sole-side, a region on both the heel-side and the crown-side, and a region on both the heel-side and the sole-side, the material thickness of the toe-side and also crown-side region of the face part being formed so as to be thinner than the material thickness on the heel-side and also sole-side region.

3. The golf club head according to claim 1, wherein the face part, with the first and second main ribs as boundaries, is divided into four regions, a region on both the toe-side and the crown-side, a region on both the toe-side and the sole-side, a region on both the heel-side and the crown-side, and a region on both the heel-side and the sole-side, the material thickness of the heel-side and also crown-side region of the face part being formed so as to be thicker than the material thickness on the toe-side and also the sole-side region.

4. The golf club head according to claim 1, wherein the face part, with the first and second main ribs as boundaries, is divided into four regions, a region on both the toe-side and the crown-side, a region on both the toe-side and the sole-side, a region on both the heel-side and the crown-side, and a region on both the heel-side and the sole-side, the material thickness on the heel-side and also the crown-side region of the face part being formed so as to be thicker than the material thickness on the toe-side and also the sole-side region, and the material thickness of the toe-side and also the crown-side region of the face part being formed so as to be thinner than the material thickness on the heel-side and also the sole-side region.

5. The golf club head according to claim 1, wherein the part of intersection between the first and second main ribs includes a point which is vertically projected from the center of gravity of the golf club head onto the surface of the face part.

6. The golf club head according to claim 1, further comprising a reinforcing rib disposed on the inner surface of the face part, the reinforcing rib extending from the part of the intersection between the first and second main ribs toward an end part of the golf club head, but being formed midway toward the end part of the face part, and the reinforcing rib having a rib thickness that gradually decreases away from the intersection part toward the end part direction.

* * * * *